United States Patent [19]

Mendenhall

[11] 4,240,754

[45] Dec. 23, 1980

[54] ASPHALTIC CONCRETE PATCH MIXING AND HEATING APPARATUS AND METHOD

[76] Inventor: Robert L. Mendenhall, 1770 Industrial Rd., Las Vegas, Nev. 89102

[21] Appl. No.: 906,734

[22] Filed: May 17, 1978

Related U.S. Application Data

[63] Continuation-in-part of Ser. No. 871,351, Jan. 23, 1978.

[51] Int. Cl.[3] ..... B28C 5/06; B28C 5/42

[52] U.S. Cl. ..... 366/4; 366/21; 366/25; 366/38; 366/54; 432/105

[58] Field of Search ..... 366/4, 21, 25, 45, 54, 366/144, 228, 233; 432/105; 34/135, 136

[56] References Cited

U.S. PATENT DOCUMENTS

| | | | |
|---|---|---|---|
| Re. 29,496 | 12/1977 | Dydzyk | 366/25 |
| 792,642 | 6/1905 | Williams | 432/105 |
| 1,240,481 | 9/1917 | Popkess | 366/25 |
| 1,578,021 | 3/1926 | Elze | 366/25 |
| 1,609,072 | 11/1926 | Elze | 366/25 |
| 1,767,746 | 6/1930 | Elze | 366/25 |
| 2,185,408 | 1/1940 | Kettenbach | 366/225 |
| 2,455,531 | 12/1948 | Stroman | 432/105 |
| 4,039,171 | 8/1977 | Shearer | 366/25 |
| 4,130,364 | 12/1978 | Brown | 366/228 |

FOREIGN PATENT DOCUMENTS

| | | | |
|---|---|---|---|
| 291763 | 10/1953 | Switzerland | 366/25 |

*Primary Examiner*—Billy S. Taylor

*Attorney, Agent, or Firm*—Seiler & Quirk

[57] ABSTRACT

An apparatus for heating and mixing an asphalt-aggregate composition comprises a drum rotatable about an axis, having a mixing and heating chamber with a restricted port at one end into which a flame and hot gases of combustion are directed and through which exhaust gases concurrently pass to atmosphere. A heating means comprises a burner for directing flame and the hot gases of combustion into the chamber at the restricted port along the drum axis of rotation and which burner is adjustable relative to the port along the drum axis of rotation. A burner assembly includes an air duct having an air entrainment port located away from substantial exposure to the drum exhaust gases. The drum includes a plurality of pegs extending into the drum chamber. Heating is carried out in a rotating drum without forming a veil or curtain of particulate composition through the hot gases of combustion.

17 Claims, 7 Drawing Figures

ASPHALTIC CONCRETE PATCH MIXING AND HEATING APPARATUS AND METHOD

REFERENCE TO OTHER APPLICATIONS

This application is a continuation-in-part of my copending application Ser. No. 871,351, filed Jan. 23, 1978.

BACKGROUND OF THE INVENTION

Patching asphaltic concrete surfaces has presented significant problems, particularly because of the seasonal unavailability of suitable patching compositions. A preferred patching composition for asphaltic concrete surfaces is a "hot-mix" comprising a heated asphalt-aggregate composition, normally at a temperature above about 200° F. Such a composition, because of the hot asphalt consistency, is semi-fluid, and easy to handle in filling a pot-hole or other cavity in the asphaltic concrete surface, and thereafter is readily worked, smoothed and compacted, to be compatible with the existing surface composition. A disadvantage of the "hot-mix" is that it is not generally available in the winter from hot-mix plants, and even when available, becomes significantly cooled as it is transported from the plant to the job site. Thus, a user must normally order a much greater amount of asphalt-aggregate patching composition than is actually required to accomplish the job, because the composition will cool and the exterior composition becoming hard and crusted by the time it arrives at the site at which it is to be used. Even then, the user must break away the hard outer crust composition, and recover the hotter, softer, and more readily workable and usable interior composition for filling the cavity. Usually the hard, cool remainder of the composition is discarded. Obviously, such a practice is wasteful, and economically undesirable.

As an alternative to the preferred hot-mix patching composition, and because that material is generally unavailable during cold weather or in the winter, patching is often accomplished utilizing an asphalt mix of emulsion or cut-back material. Although such a composition remains somewhat semi-fluid and is workable at colder temperatures than the hot-mix material, it is not as compatible with the existing asphaltic concrete surfaces, generally has a poorer longevity, and thus must be replaced more frequently.

SUMMARY OF THE INVENTION

According to the present invention, a very practical, portable apparatus is provided for producing a hot-mix asphalt-aggregate composition. The apparatus may be readily moved from place to place, so that composition may be mixed and heated to form a hot-mix at the job site, and immediately used. Thus, because of the apparatus, a method is provided for achieving a hot-mix asphalt-aggregate composition at the job site, for immediate use, regardless of cold temperature conditions, and the non-availability of commercial hot-mix materials. A specific advantageous feature of the apparatus is a restricted port open to atmosphere and contiguous with the heating and mixing chamber, into which flame and hot gases of combustion for heating the composition are introduced, and out of which port and simultaneously, exhaust gases from the flame and combusted asphalt hydrocarbon volatiles, are vented. The apparatus of the invention is also provided with features for improved operations. A burner assembly includes means for advantageously moving the burner nozzle closer or further from the drum along the axis of rotation and directs the flame and hot gases into the drum through the center of the drum port, thereby achieving optimum heating efficiency in the drum and concurrent exhaust of gases through the same port, between the incoming gases and peripheral port edges. An air duct and cover member for the burner assembly includes an entrainment port located away from the drum port, which obviates danger of flame extinguishment due to exhausted combustion products and water vapor. Improved heating efficiency and reduced hydrocarbon volatilization and asphalt degradation are further achieved by a process which prevents formation of a veil or curtain of particulate composition through the flame and hot gases as the drum is rotated. The drum also includes a plurality of pins extending into the drum cavity from the interior drum surface, which pins assist in separating colder chunks from the hotter mass of smaller particles and in directing heat into the composition thereby further improving process efficiency. A further apparatus feature includes a hopper bottom cover plate member for closing the hopper and preventing a draft through the drum when not in use, and having multiple opening plates for varying the feed rate. The advantages of the apparatus and the improvements and use thereof will be evident from the following detailed description.

DETAILED DESCRIPTION OF THE INVENTION

Figure 1:
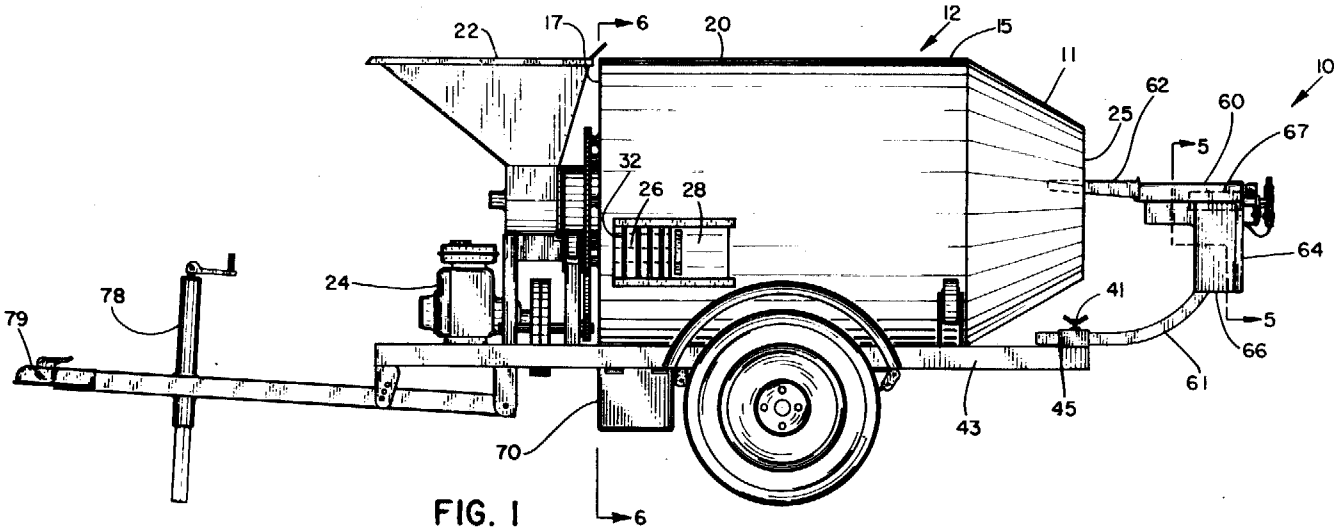
FIG. 1 is a side view of the apparatus.

In FIG. 1 there is shown the apparatus of the invention comprising a drum assembly 12 and burner assembly 10. The drum assembly includes a drum 20 which is hollow, and which drum may be substantially closed except for a restricted port 25 at the forward end. Flame and hot gases of combustion from the burner assembly for heating asphalt-aggregate composition are directed through the restricted port, and at the same time, the exhaust gases from the drum, are vented to the atmosphere through the same port. More specifically, the flame and hot burner gases are introduced through the center of the port, while the exhaust gases, moving in the opposite direction, pass between the hot incoming gases and the edge of the port. Asphalt-aggregate composition may also be introduced and/or removed through port 25. The characteristics of the drum are a preferably circularly shaped wall 15 extending forwardly from back wall 17, and interiorally of which wall is formed the major portion of the mixing chamber, and a downwardly tapered wall portion 11. This tapered wall is contiguous with wall portion 15, and gradually tapers therefrom to port 25. The port is preferably also circular, whereby the port diameter is smaller than the maximum chamber diameter defined within circular wall portion 15. Although tapered wall 11 may be advantageous in recovering composition from the drum, its shape is not a critical feature.

The apparatus includes means for rotatably driving the drum, preferably about an axis extending substantially along the center of the drum, and through the center of the restricted port 25 and the back plate. Means for rotating the drum include engine or motor 24, cooperating with suitable drive means such as gears, chains, belts, or the like. Also included in the apparatus is a hopper 22, a feed screw 34, and feed tube 36, shown in FIG. 2, for introducing composition into one end of the drum. Further description of these components, and features and use thereof are described in my aforesaid co-pending application, which descriptions are incorporated herein by reference.

Improved burner assembly 10 includes a cover and duct member 60, which will be more fully explained hereinafter. An important feature of the burner assembly of the invention and its use is for directing flame and hot gases of combustion from the burner nozzle into the center of port 25, and into the drum along its axis of rotation. Moreover, the burner assembly includes a support shaft 61 which cooperates with bracket 45 and locking member 41 so that adjustment or variation of the burner assembly relative to the drum, as previously described, is made along the drum axis of rotation. Accordingly, the burner assembly is moved closer to or away from the drum in such a manner that the burner nozzle moves substantially along the drum axis of rotation whenever this adjustment or variation of distance between the burner assembly and drum is accomplished. This feature and method of so directing the flame and hot gases of combustion along the drum axis of rotation and into the center of port 25 is important to optimize the heating efficiency within the drum, and at the same time the burning of hydrocarbon combustibles within the drum chamber, as well as to best provide for the simultaneous or concurrent ingress and egress of gases through the port. Without such a feature, if the flame and hot gases of combustion enter the port at an angle relative to the drum axis of rotation, the gases and heat will be directed toward, impinge upon, and be deflected from the drum interior surface or composition itself, thereby spot heating, which is undesirable. For example, if the flame and hot gases are directed to and deflected from the interior drum surface, a significant portion of the heat will be lost through the exterior drum surface, because of unnecessarily overheating the drum at a limited area, thereby decreasing heating efficiency of the operation. On the other hand, if the flame and hot gases of combustion are directed to and impinge upon the composition, asphalt containing particles exposed on the outer surface may become too hot, thereby causing product degradation by burning, coking, oxidation, which is obviously undesirable. Such oxidation or burning of the asphalt, will also increase the smoking and volatilization of hydrocarbons, also undesirable.

On the other hand, where the flame and hot gases are directed along the drum axis of rotation according to the invention, they will reach into the drum interior to the maximum extent, thereby uniformly heating the drum surface and exposed composition, as well as to uniformly disperse the heat in the internal drum atmosphere, and maximize combustion of asphalt hydrocarbon volatiles. It has been found that to achieve desired combustion of volatiles, a gaseous temperature of at least about 600° F. is required, although some light ends of volatile asphalt hydrocarbons will flash at about 200°-300° F. Moreover, to maximize the combustion it is desirable that the 600° F. or greater gaseous temperature be achieved and maintained as deep as possible into the drum, at least into the back half of the drum interior. With the hot gases being uniformly dispersed along the center of the drum and its axis of rotation, uniform displacement of the exhaust gases within the drum interior and outwardly vented to atmosphere through the drum port, will also be realized. The achievement of these same features are also important in requiring the movement of the burner assembly, and specifically the burner nozzle, along the drum axis of rotation when varying the distance between the burner and the drum. Again, if the burner nozzle is moved to direct the flame and hot gases off-center relative to the drum port, albeit parallel with the drum axis rotation, a non-uniform dispersion of the heat within the drum will be caused, as well as an uneven draft of the incoming and outgoing gases through the drum port.

Another important feature of the process of the invention and use of the apparatus, is to prevent the formation of a veil or curtain of composition particles as the drum is rotated. State of the art apparatus lift composition particles by using lifters or flights, and carry them up the side of the rotating drum, and allow them to fall gravationally through the drum interior, often near or at the drum center, as a particulate veil. Heretofore, throughout the asphaltic concrete production industry it has been considered desirable, if not necessary, to so expose the composition particles through the hot gases of combustion during heating. However, such exposure of the particulate composition tends to cause smaller particles to become heated to a substantially greater extent than the larger particles, thereby further increasing volatilization of the asphalt hydrocarbons, and again, increasing oxidation, burning, and smoking within the drum. Moreover, formation of such a veil or curtain of particles within the drum interior, acts as a barrier to the hot gases from penetrating further into the drum, and results in a substantial temperature differential along the drum interior length, between the forward and the rear portions, which is further undesirable for maximum process efficiency. Such a veil effect also acts to deflect and reverse the hot gas flow well within the forward portion of the drum interior. With the heat being so concentrated in the forward drum interior portion, not only is composition heating non-uniform, but substantial combustion of volatilized asphalt hydrocarbons in the back portion will not be achieved.

In order to prevent these above noted problems caused by forming a particulate composition veil as the drum is rotated, according to the present process, the composition is not lifted by flights, trays, lifters, or the like. Instead, elongated pegs are provided along the drum interior, which do not alternately lift and drop composition particles. Moreover, drum rotation is carried out at a speed so as to prevent the composition from being carried far enough up the drum side by centrifugal force, and then dropped gravitationally as a veil or curtain. It will be understood that suitable drum rotational speeds will be a function of the drum diameter. Specifically, it has been found that rotational drum speeds of up to, or less than, about 250 feet per minute, measured at the drum edge or periphery, will be suitable. Specific speeds can be easily selected by an operator to meet this requirement, whereby the composition will roll and tumble, and become adequately heated, but, without the disadvantages as previously described.

Figure 5:
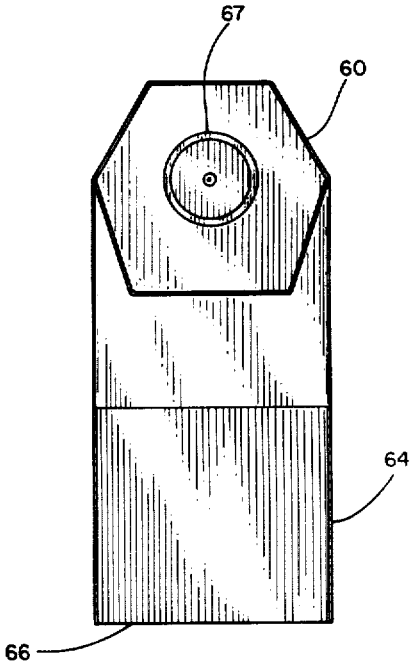
FIG. 5 is a front view, partially in section, of the burner duct and cover, taken along line 5—5 of FIG. 1.

FIGS. 1 and 5 illustrate an improvement of the burner assembly, wherein a cover and air duct 60 is secured over burner nozzle 67. The improved feature of such a duct is to provide an offset or displaced air entrainment port 66. It will be understood that as gases such as propane, butane, or natural gas, or the like are directed toward the drum from nozzle 67, it is ignited as it is exposed to atmospheric oxygen containing gas or air at or near the tip of the nozzle. Because substantial exhaust gases are being uniformly dispersed outwardly from drum port 25, containing substantial amounts of carbon dioxide, where the air around the nozzle point contains significant amounts of such exhaust gases, oxidation of the burner gases may not be as efficient as desired, thereby reducing the heat achieved. This requirement is not only true for primary combustion of the gaseous fuel at the burner nozzle point but also for secondary combustion which increases the flame and heat realized downstream from the burner nozzle. In addition, where the asphalt-aggregate composition being mixed contains water, water vapor will also be present in the exhaust. If substantial water vapor is present near the burner nozzle, the flame may even be extinguished, which also presents a danger of explosion. To avoid these problems, the air duct 60 is provided with air entrainment port 66 which is well away from the drum port 25, and not aligned along the drum axis of rotation where exhaust gases are uniformly dispersed. Thus, with primary and secondary air for oxidation of the gaseous fuel being entrained from such an offset port, improved oxidation and full realization of the heat from the burner is achieved. The air entrained through air entrainment port 66 will be drawn upwardly along duct stack 64, and into and around the interior duct and cover chamber in which burner nozzle 67 is exposed. An optional burner assembly forward cowl or cover 62, preferably removeable from air duct 60, may also be used for assisting in directing the flame and hot gases into the center of port 25, and for shaping and reducing deflection of the flame prior to its entering the port. Again, as shown, the cover 62 is removeable, so that it may be used, or not used, as desired.

Figure 2:
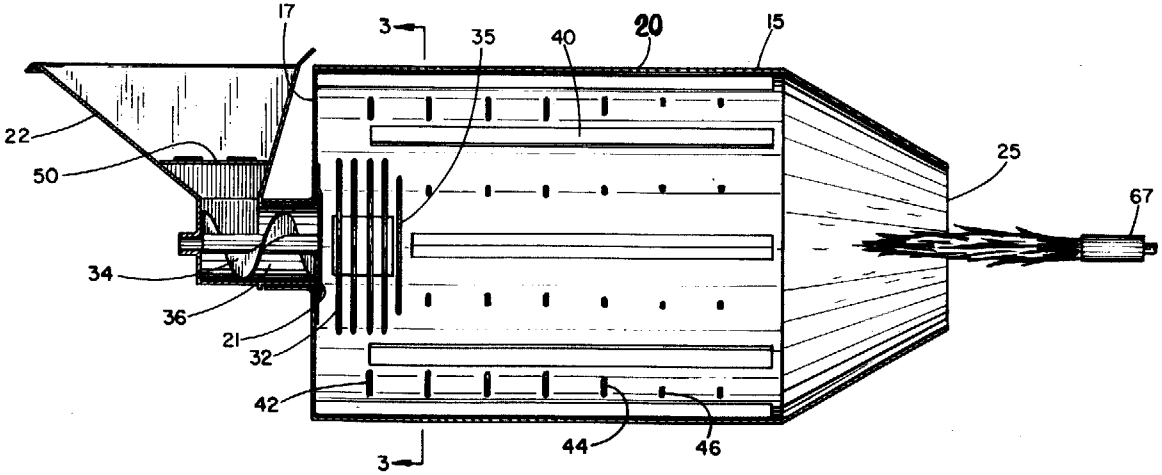
FIG. 2 is a side sectional elevation of the drum and feed assembly showing the interior features thereof.
Figure 3:
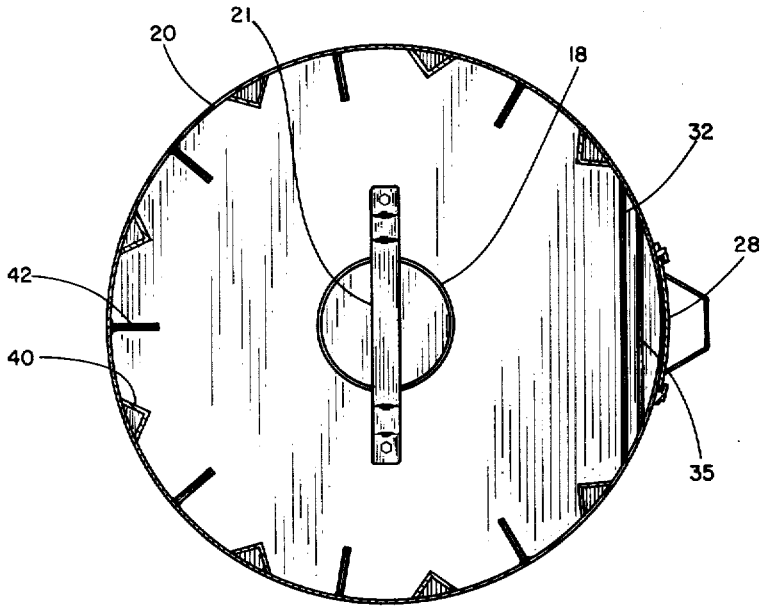
FIG. 3 is a front sectional view of the drum portion of the apparatus, taken along line 3—3 of FIG. 2.

FIGS. 2 and 3 illustrate a still further feature and embodiment of the improved apparatus of the invention. In the drum interior are located a plurality of protrubances, in the form of pins or pegs, which extend outwardly and radially from the interior drum surface to the interior chamber. As shown in FIG. 3, these pegs are preferably of different lengths, the longer pegs being located rearwardly in the drum, i.e., furthest away from port 25, with the shorter pegs more forwardly along the drum interior. In the example shown, pegs of three different lengths, the longest 42, intermediate 44, and shorter 46 are used. A primary purpose of the pegs is to hold-off or maintain separation of larger composition particles, such as chunks, from the interior drum surface and thereby keeping them closer to the center of the drum where the gases from the burner are hottest. In this way the chunks become heated from the outside, and as a portion of the mass is heated sufficiently to cause the asphalt to become softened and plastic, that portion will fall away from the cooler mass as the material tumbles during drum rotation. This process will continue until the chunk composition becomes fully heated and softened, and is more or less homogeneously mixed with the remainder of mass of composition particles being processed. Without such pegs to hold-off the relatively large particles and chunks, because of their weight, they would work their way down through the composition to the interior drum surface, where heating and softening of the hard asphalt would occur, undesirably, more slowly. Thus, the pegs substantially assist and improve the processing of larger composition particles and chunks, conveniently introduced through port 25. Such a feature obviates the necessity of crushing the materials prior to processing, obviously a significant advantage, especially on jobsite operations using recycle asphaltic concrete, and where crushing and screening equipment is not conveniently available. For example, where composition being treated is asphaltic concrete as might normally be obtained by breaking up pavement with a jack hammer or other apparatus, the material will include particles of a nominal size greater than 2–3 inches across, and particularly 4 to 6 inches or more. It is to the treatment of such materials that the apparatus of the invention is especially advantageous. The presence of the pegs on the drum interior surface, is also found to increase heating efficiency, as well as to prevent or reduce the particulate veil effect for the reasons previously explained. It has been found that the pegs will pick up heat when they are not covered by composition, and are exposed within the drum interior, and transfer heat to the composition as the drum continues to rotate and the hot pegs and adjacent drum surface make contact with the composition. The pegs also assist in directing the composition toward the back of the drum for recovery, where the composition is loaded through drum port 25 and removed from port 26. However, the pegs do not themselves lift the composition, as would trays, lifters, and flights used in state of the art devices.

Preferably the pegs will be between about ½ and about 4 inches long, although for some uses longer and/or shorter pegs might be desired. The shorter pegs are used in the forward end of the drum, nearest port 25, and longer pegs are used nearer the back. The use of longer pegs near the front of the drum, where the composition particles are loaded, would hold the larger particles and chunks too near the center of the drum interior thereby possibly overheating exposed material on the particle surface so near the center drum axis, where incoming gas temperatures near the port are hottest. Large pieces of material held near the drum center and close to drum port 25 would also interfere somewhat with the movement of hot gases being directed from the drum port to the back, and oppositely moving exhaust gases. However, where chunks are present in the composition mass nearing the back of the drum, it is desirable to more expose them to the hotter gases nearer the drum center, to hasten the asphalt heating and particle size reduction. It is also preferred to align the pegs along rows, parallel with the drum axis of rotation in the manner shown in FIGS. 2 and 3. As for spacing between the pegs, between about 2 and about 10 inches is normally adequate, and about 4 to 6 inches being especially useful.

Where composition is substantially of smaller particulate form, it is preferably introduced into the apparatus via hopper 22. For example, where the particles will pass a 2–3 inch mesh sieve, all of the composition may be introduced into the drum via hopper 22, and recovery port 26 is closed, and product recovered through restricted port 25. In the heating and processing of such smaller particulate composition in the apparatus, the variation of the length of pegs from front to rear or visa versa is not so important.

Also shown are angle iron ribs 40, which extend along the drum interior, again preferably parallel with the rows of pegs. The ribs act to interrupt the otherwise smooth interior drum surface to prevent the composition mass from merely sliding along the surface during drum rotation, and thus assist the composition tumbling and mixing operation. The ribs further assist in transferring heat along the drum surface, especially more uniformly between the front and back of the drum. These ribs become heated as they are exposed to the gases within the drum, and transfer heat as the composition tumbles over these members during drum rotation.

Figure 4:
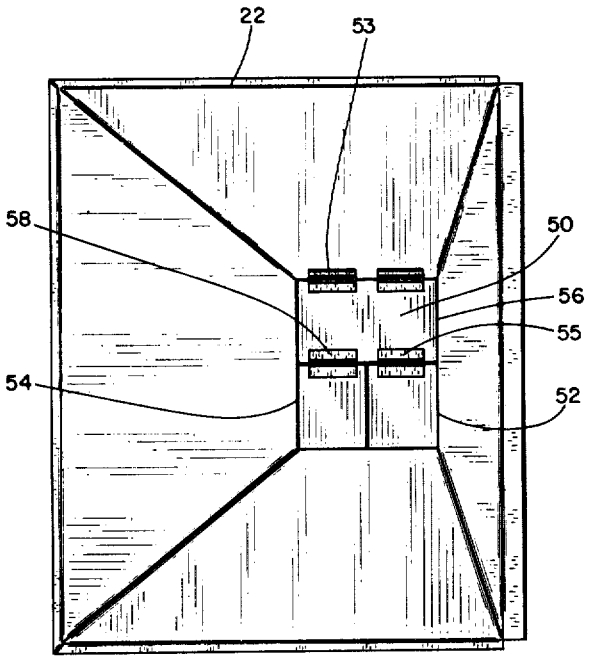
FIG. 4 is a top view of the hopper, showing the bottom cover plate.

The apparatus of the present invention is further improved by a multiple hinged plate member 50 located near the bottom of chute or hopper 22 as illustrated in FIGS. 2 and 4. The plate member offers the advantage of both assisting in the regulation or restriction of composition introduced into the drum through the hopper, via screw feed 34 and feed passageway 36, and in reducing or preventing possible draft through the drum during processing, when feeding through the hopper is not used. The plate member 50 may incorporate any desired number of hinged plate portions, depending on the extent of composition feed regulation desired. The embodiment shown utilizes three hinged plate portions 52, 54 and 56. Hinged plate portions 52 and 54 are of approximately equal size, and are secured to larger hinged plate portion 56 by hinges 55 and 58, respectively. The larger plate portion is secured to an interior side surface of hopper 22 by hinge 53. The opening size for entry and feed of composition placed in hopper 22 and fed by feed screw 34 into the drum is varied by simply folding one or more of the plate portions on their respective hinges. For example, where full feed access is desired, all the plates are folded on their hinges to fully expose the opening at the bottom of the hopper. However, where reduced feed rate is desired, only one or both of the smaller plate portions 52 or 54 is folded on their respective hinges to lie against larger plate portion 50.

In addition to regulating or restricting the feed rate, as above described, the plate member serves to further reduce the possibility of draft through the drum via feed passageway 36, when composition is not being fed through the hopper. In such a case, all of the plate portions are disposed in a manner illustrated in FIGS. 2 and 4 so that the opening at the bottom of hopper 22 is closed. Thus, although feed screw 34 occludes feed passageway 36 substantially as illustrated in FIG. 2, thereby preventing any substantial draft through the feed passageway from the interior of drum 20 during processing, with the plate portions closed, the possibility of such a draft is even further reduced. The substantial elimination of draft from the interior of the drum during processing is an important and essential part of the apparatus of the invention and its use. Again, recognizing that according to the above description, it is desired that the exhaust gases from the drum interior are vented through port 25, the occlusion of feed passageway 36 as well as hopper 22, further prevents the possibility of exhaust gases, as well as any burned or unburned asphalt hydrocarbon volatiles, from escaping from within the drum, except as previously described, through port 25, after combustion is substantially complete.

As indicated in my aforesaid co-pending application, composition may be fed or introduced into the apparatus through port 25, or hopper 22. Where the composition includes rather large chunks, all of the material may simply be fed into restricted port 25, and recovered, after heating, through recovery port 26, located on the side of the drum, near the opposite end from the forward port. Thus, where composition size ranges are significantly varied, especially with the presence of the larger chunks, drum feeding through hopper 22 is not used. Such a feature obviates the necessity of further crushing or breaking up of composition introduced into the drum, with the upper limit of composition sizes being limited only by practical handling capabilities and the restricted port 25 opening size. When feeding is accomplished through port 25, recovery port 26, located on the side of the drum, near the end opposite port 25, is normally used, and through which the interior of the drum is exposed. A door or closure member 28 is used for selectively covering or closing the recovery port, which will be closed at all times, except where product is being recovered. The cover is conveniently slideably mounted, and a grate comprising bars 32 and 35, is located over the port and secured to the interior drum surface. The grate bars are separated by spaces which determine the size of particles recovered through the port. In this manner, when the recovery port is open or exposed, large chunks of composition will be prevented from falling through the port. Other restrictive means, such as a screen or the like may be used instead.

As the asphalt-aggregate composition is gradually heated from ambient temperatures within the rotating drum, as the composition is exposed to the hot gases of combustion and to heat transferred from the interior drum surface, hydrocarbon volatiles are released from the asphalt, which volatiles are in the form of noxious combustible fumes, normally visible, expecially if the hydrocarbons were to be directly released to the atmosphere from the drum. It is to the avoidance of such pollution that the apparatus and method of the invention is particularly directed. Because of restricted port 25, the hydrocarbon volatiles and smoke given off by the hot asphalt within the drum, are held in the mixing chamber rather than being immediately vented into the atmosphere, as they normally would without the restricted port. Moreover, as the flame and hot gases of combustion are directed into the drum interior through the restricted drum port, the hydrocarbon volatiles are ignited, thereby being more fully combusted or oxidized to carbon dioxide and water. Such combustion often produces a visible blue flame or glow within the heating chamber. These products of combustion are much more enviornmentally acceptable for being vented to the atmosphere as compared to the smoke or other visible non-combusted volatile hydrocarbon materials given off by the heated asphalt. The exhaust gases from within the drum, which include the combined exhaust from the gases of combustion from the burner, and the burned asphalt hydrocarbon volatiles, are also vented through the restricted port to the atmosphere, simultaneously with the introduction of the hot burner gases into the drum. Again, with the flame and hot combustion gases directed into the center of the restricted port, the exhaust gases are vented through the more or less annular space between the hot gases and drum port peripheral edge.

In achieving combustion of the hydrocarbons volatilized from the heated asphalt within the drum, it is important that the position of the nozzle 67, be adjusted relative to restricted drum port 25 to optimize this internal drum combustion and at the same time to reduce smoke and uncombusted hydrocarbon volatiles vented into the atmosphere. Where the flame shield or burner nozzle are placed too far into the drum interior, there will occur a "blow-back" effect of forcing these asphalt generated volatiles out of the drum port prematurely, or prior to full combustion. On the other hand, if the nozzle or shield are backed too far from the restricted drum port, the burner gases may be too cool by the time they reach the drum interior to fully ignite the asphalt hydrocarbon volatiles. Further, such a significant distance between the flame nozzle and drum port will also result in flame deflection and concomitant loss of process efficiency, especially where windy conditions exist. Thus, an operator will make adjustment of the burner nozzle or flame shield relative to the drum port 25 to take the greatest advantage of the process, and whereby the exhaust gases being vented to atmosphere may pass between the incoming flame and hot burner gases and the restricted port lip or edge.

Figure 6:
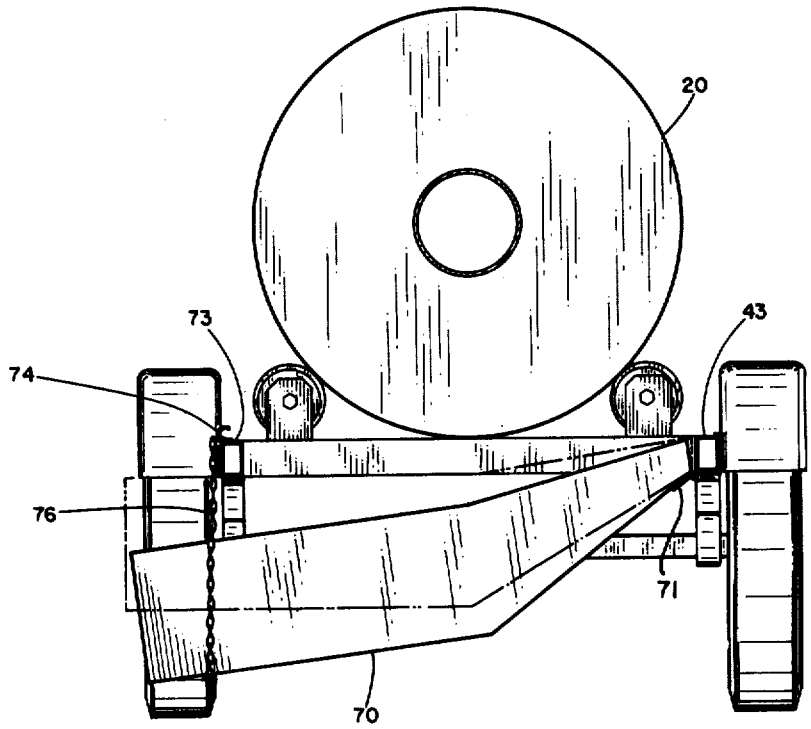
FIG. 6 is an end view of a portion of the apparatus taken along line 6—6 of FIG. 1.
Figure 7:
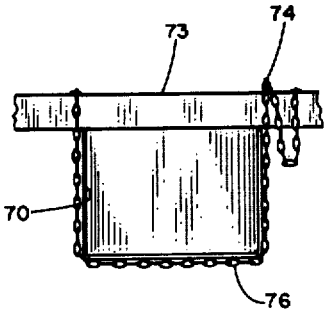
FIG. 7 is a partial view of a portion of the apparatus showing the product recovery chute secured in a travel position.

In FIGS. 1, 6 and 7 there is shown a product recovery trough that may be secured on the apparatus, especially useful for conveniently receiving and directing hot composition recovered through side port 26. The trough 70, is secured on a frame member 43 by hinge 71 on one end of the trough, the other being open and free to be moved vertically. The trough is located directly beneath port 26, so that with cover 28 opened, product in the drum will fall through the port and into the trough. Means for selectively elevating and lowering the trough between a substantially horizontal position for holding composition and during apparatus transportation, and lowered for directing recovered product comprises a chain 76, secured on frame member 73. A hook 74 is used for securing the chain when it is desired to restrict the movement of trough 70 and hold it in a suitable position for being transported, as shown in FIG. 7, and in phantom in FIG. 6. For composition recovery, the trough is lowered via hinge 71 to the position shown in FIG. 6, and hot material is readily directed along the trough to any desired area. Other recovery means may be used, as may other devices for securing such a trough.

Other components of the apparatus shown include an adjustable jack 78 for varying the tilt of the drum, to accommodate different leveling requirements, and especially useful for product recovery through port 25. A trailer hitch locking device 79 is also shown. The size of the apparatus includes smaller, easily portable drums between about 3 and about 5 feet in diameter, up to even 10 feet or more. However, regardless of the drum diameter, it will have a longer dimension. Thus, for example, a drum of 3 feet diameter will conveniently have a length of at least about 40 inches, not including any tapered portion. Other features and modifications of the apparatus within the purview of the invention herein will be evident to those skilled in the art, as well as advantages of the apparatus and the process disclosed herein.

I claim:

1. A process for heating and mixing particles of a composition comprising asphalt and aggregate in a rotatable drum comprising placing the composition particles into the drum, introducing hot gases of combustion into said drum through a port, open to atmosphere, simultaneously rotating said drum at a speed to prevent formation of a veil or curtain of the particulate composition through said hot gases of combustion, and concurrently venting exhaust gases from said drum directly to atmosphere through said port.

2. The process of claim 1 wherein the drum is rotated at a speed up to about 250 feet per minute measured along the outside drum edge.

3. The process of claim 1 wherein said hot gases are directed into said rotating drum through the center of said port and along the axis of drum rotation, and said exhaust gases are vented directly to atmosphere between said hot gases and a peripheral edge of said port.

4. The process of claim 1 or 3 wherein the composition is introduced into said drum through said port.

5. The process of claims 1 or 3 wherein the composition is removed from said drum through said port.

6. The process of claims 1 or 3 wherein air supplied to a burner nozzle for said hot gases of combustion is drawn from atmosphere away from substantially concentrated exhaust gases being vented from said port.

7. The process of claims 1 or 3 wherein the temperature of gases in a half of the drum interior furthest from said port are at least 600° F.

8. An apparatus for heating and mixing asphalt-aggregate composition comprising a drum rotatable about an axis, a first port at a first end of said drum through which hot gases of combustion are directed, said first port being restricted relative to the drum interior, open to atmosphere, and where the axis of drum rotation extends through said first port, a second port having closure means cooperating therewith for selectively opening and closing said port and located at a second end of said drum opposite said first end, a burner member located adjacent said first port for introducing hot gases of combustion into said drum through said first port, and wherein the drum has an interior heating and mixing chamber surface having a plurality of elongated pegs extending into the chamber, said pegs being of at least two different lengths with the shorter pegs located in a portion of the drum nearest the first port.

9. Apparatus of claim 8 wherein said burner member includes a nozzle for directing flame and hot gases of combustion into said drum port and an air duct for directing air to said nozzle, and having an air entrainment port located at a distance from said nozzle and from said port to prevent substantial amounts of exhaust gases vented from said first port of said drum from being drawn into said air entrainment port.

10. Apparatus of claim 8 wherein the pegs are aligned in rows extending substantially parallel with the axis of drum rotation.

11. Apparatus of claim 8 wherein said pegs are between about ½ and about 4 inches long.

12. Apparatus of claim 11 wherein said pegs are spaced apart between about 2 and about 10 inches.

13. An apparatus for heating and mixing asphalt-aggregate composition comprising a rotatable drum having a port, open to atmosphere, for introducing the composition, a burner adjacent said port for directing flame and hot gases of combustion therein, an interior mixing chamber in which the surfce of said chamber has a plurality of elongated protuberances extending into said chamber and wherein said protuberances comprise elongated pegs of at least two different lengths the shorter pegs being located along a portion of the drum, nearest said port.

14. Apparatus of claim 13 wherein the pegs are aligned in rows extending substantially parallel with the axis of drum rotation.

15. Apparatus of claim 13 wherein said pegs are between about ½ and about 4 inches long.

16. Apparatus of claim 15 wherein said pegs are spaced apart between about 2 and about 10 inches.

17. An apparatus for heating and mixing asphalt-aggregate composition comprising a drum rotatable about an axis, a first port at a first end of said drum through which hot gases of combustion are directed, said first port being restricted relative to the drum interior, open to atmosphere, and where the axis of drum rotation extends through said first port, a second port having closure means cooperating therewith for selectively opening and closing said port and located at a second end of said drum opposite said first end, a burner member located adjacent said first port for introducing hot gases of combustion into said drum through said first port, and a hopper for introducing composition into the second end of said drum, said hopper having a plate comprising a plurality of segments for varying the rate of composition fed to said drum.

* * * * *